US005332357A

United States Patent [19]

Tubbs

[11] Patent Number: 5,332,357

[45] Date of Patent: Jul. 26, 1994

[54] STATOR VANE ASSEMBLY FOR CONTROLLING AIR FLOW IN A GAS TURBINE ENGIEN

[75] Inventor: Henry Tubbs, Tetbury, Great Britain

[73] Assignee: Industria de Turbo Propulsores S.A., Zamudio, Spain

[21] Appl. No.: 52,550

[22] Filed: Apr. 23, 1993

[30] Foreign Application Priority Data

Apr. 23, 1992 [ES] Spain ..... 9200855

[51] Int. Cl.[5] ..... F01D 17/16

[52] U.S. Cl. ..... 415/160; 415/115; 415/116; 415/150

[58] Field of Search ..... 415/115, 116, 150, 159, 415/160, 161, 162

[56] References Cited

U.S. PATENT DOCUMENTS 2,856,758 10/1958 Eggleston et al. ..... 415/160
3,237,918 3/1966 Le Bell et al. ..... 415/161
4,297,077 10/1981 Durgin et al. ..... 415/115
4,705,452 11/1987 Karadimas ..... 415/115
5,193,975 3/1993 Bird et al. ..... 415/115
5,207,558 5/1993 Hagle et al. ..... 415/160

*Primary Examiner*—Edward K. Look
*Assistant Examiner*—Christopher Verdier
*Attorney, Agent, or Firm*—Brumbaugh, Graves, Donoghue & Raymond

[57] ABSTRACT

In an annular array of stator aerofoil vanes (25) each of the vanes (25) has a flank portion (35) which is pivotally attached to the remainder of its associated vane (25). Actuation means (60) are provided to pivot each flank portion (35) relative to the remainder of its associated vane (25). Such movement of the flank portions (35) provides variation in the cross-sectional areas of the throat (61) defined between adjacent stator vanes (25).

7 Claims, 3 Drawing Sheets

54
38
60
39
52
43
40
33
25
42
46
43
45
47
31
35
44
29
45
36
53
34
46a
51
48
30
49
41
50
37
57
32
C
54
38
60
39
52
43
40
33
25
42
46
43
45
47
31
35
44
29
45
36
53
34
46a
51
48
30
49
41
50
37
57
32

STATOR VANE ASSEMBLY FOR CONTROLLING AIR FLOW IN A GAS TURBINE ENGIEN

BACKGROUND OF THE INVENTION

This invention relates to a gas turbine engine stator vane assembly and in particular to a vane assembly having an effective flow area which is variable.

Modern ducted fan gas turbine engines conventionally have two or three shafts interconnecting the various rotary components of their compressors and turbines. It is desirable to vary the work distribution between these shafts in order to ensure efficient engine performance over a wide range of operating conditions. Such work distribution between the engine shafts is principally governed by the effective flow areas of the individual engine turbines. Similar requirements apply to multishaft gas turbines providing shaft drive.

It has been proposed to vary the turbine effective flow areas by the use of stator guide vanes which are rotatable about their longitudinal axis. However with such vanes, great difficulty is usually encountered in achieving an effective gas seal between the rotatable vane portions and the static portions adjacent those rotatable portions. Additionally, turbine components are subject to high aerodynamic and mechanical loads. This makes it very difficult to provide actuating mechanisms which are capable of providing effective vane rotation with sealing whilst being acceptably robust and light in weight.

It has also been proposed to use jets of cool air to obstruct the areas between adjacent stator guide vanes. However these have been found to bring about unacceptable performance penalties.

SUMMARY OF THE INVENTION

It is an object of the present invention to provide a gas turbine engine stator vane assembly which substantially obviates these difficulties.

According to the present invention, a gas turbine stator vane assembly comprises an annular array of substantially radially extending stator vanes circumferentially spaced apart so that throats are defined between circumferentially adjacent stator vanes, each of said stator vanes comprising an aerofoil cross-section portion having a leading edge, a trailing edge, a pressure flank and a suction flank, each of said flanks interconnecting said leading and trailing edges, at least a portion of one of said flanks of each of said vanes being pivotally attached to the remainder of its associated vane to pivot about a line which is normal to the general direction of the operation flow of gases over said flank portion to provide variation in the cross-sectional areas of said throats between adjacent stator vanes, actuation means being provided to pivot said flank portions about their pivot lines to facilitate said variation in throat cross-sectional area.

BRIEF DESCRIPTION OF THE DRAWING

The present invention will now be described, by way of example, with reference to the accompanying drawings in which.

DETAILED DESCRIPTION OF THE PREFERRED EMBODIMENTS

Figure 1:
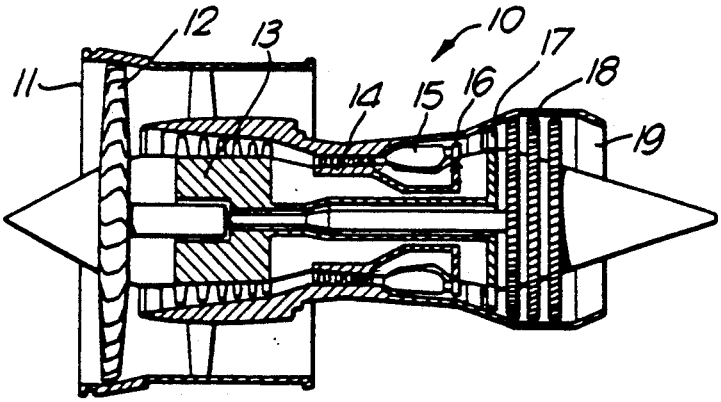
FIG. 1 is a sectional side view of a ducted fan gas turbine engine provided with a stator vane assembly in accordance with the present invention.

With reference to FIG. 1 a ducted fan gas turbine engine generally indicated at 10 comprises, in axial flow series, an air inlet 11, a ducted fan 12, intermediate and high pressure compressors 13 and 14 respectively, combustion equipment 15, high, intermediate and low pressure turbines 16, 17 and 18 respectively and an exhaust nozzle 19.

The engine 10 functions in the conventional manner. Thus air drawn in through the air inlet 11 is compressed by the fan 12. The air so compressed is then divided into two flows, the first of which is directed to atmosphere to provide propulsive thrust. The second flow is directed into the intermediate pressure compressor 13 and subsequently into the high pressure compressor 14 where additional compression of the air takes place. The compressed air is directed into the combustion equipment 15 and then mixed with fuel. There the mixture is combusted and the resultant combustion products are directed to drive the high pressure turbine 16. They then proceed to flow through and drive the intermediate and low pressure turbines 17 and 18 respectively before exhausting through the exhaust nozzle 19 to provide additional thrust.

Coaxial shafts interconnect the various compressors and turbines. Thus the low pressure turbine 18 drives the fan 12, the intermediate pressure turbine 17 drives the intermediate pressure compressor 13 and the high pressure turbine 16 drives the high pressure compressor 14.

Figure 2:
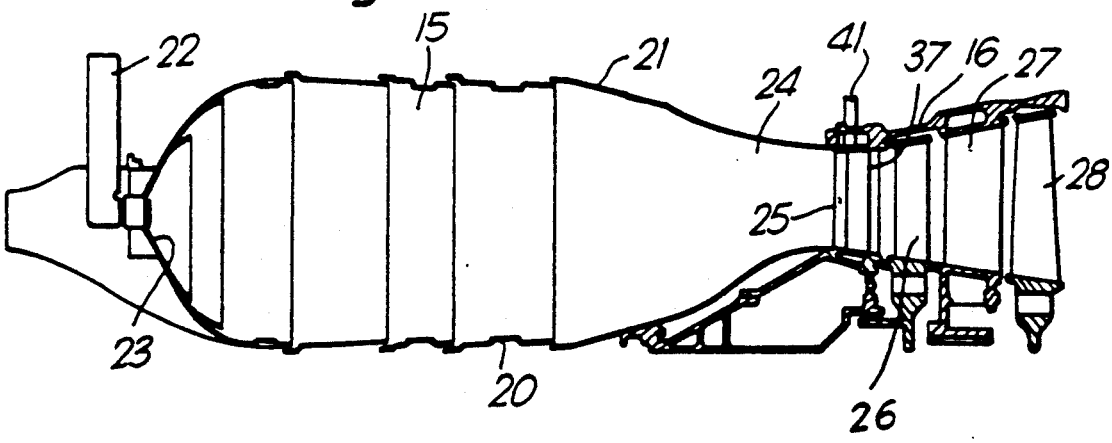
FIG. 2 is a sectional side view, on an enlarged scale, of a portion of the combustion and turbine sections of the ducted fan gas turbine engine shown in FIG. 1, one of the turbine sections incorporating a stator vane assembly in accordance with the present invention.

Referring now to FIG. 2, the combustion equipment 15 is of the conventional annular type having radially inner and outer walls 20 and 21 respectively. Fuel is injected into the combustion equipment 15 through a plurality of injectors 22, one of which can be seen in the drawing. Air enters the combustion equipment 15 through swirler vanes 23 positioned around each fuel injector 22 outlet and through a plurality of air inlets provided in the combustor walls 20 and 21.

The gaseous combustion products are exhausted from the downstream end 24 of the combustion equipment on to an annular array of stator guide vanes 25. The stator guide vanes 25 constitute the upstream end of the high pressure turbine 16. They serve to direct the combustion products on to an annular array of rotor blades 26 at the appropriate angle. The rotor blades 26 are thereby caused to rotate and drive the high pressure compressor 14. The combustion products are then directed by a second annular array of stator guide vanes 27 which constitute the upstream end of the intermediate pressure turbine 18. The stator guide vanes 27 direct the combustion products on to a second annular array of rotor aerofoil blades 28 which drive the intermediate pressure compressor 13.

The present invention is here particularly concerned with the high pressure turbine stator aerofoil vanes 25.

It will be appreciated however that it may also be applicable to other stator aerofoil vane arrays in the intermediate and low pressure turbines 17 and 18 respectively.

Figure 3:
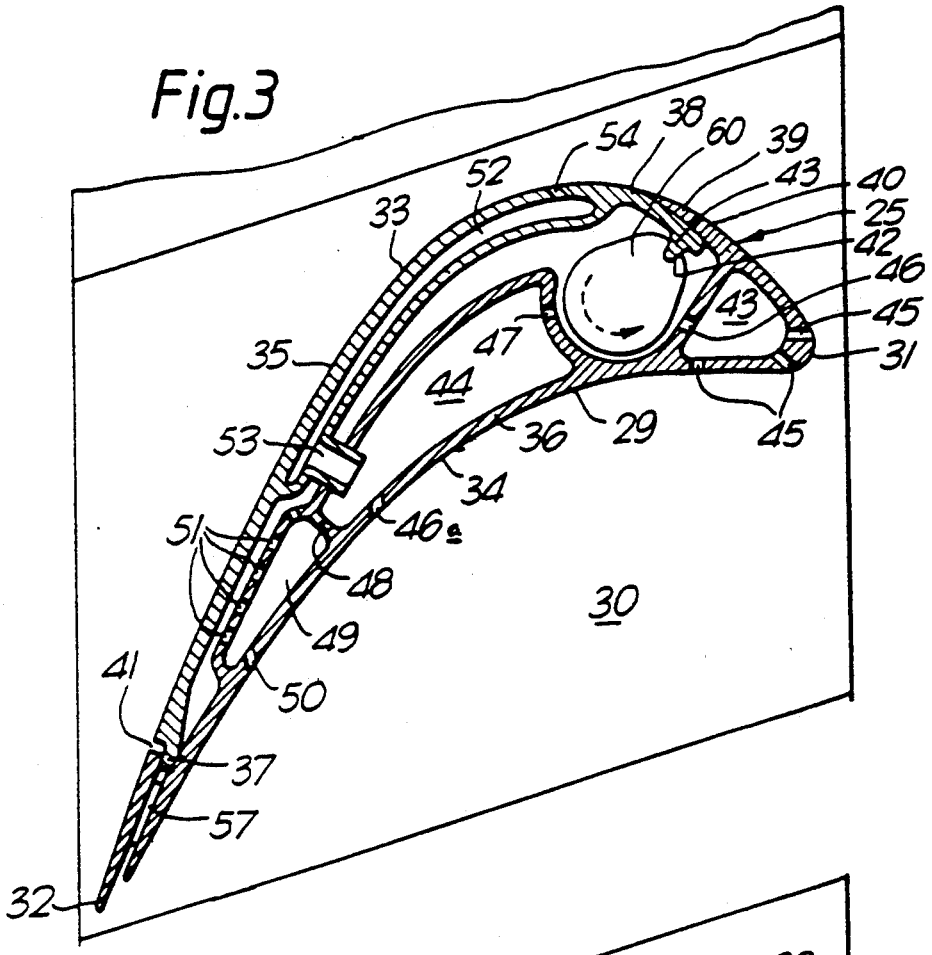
FIG. 3 is a cross-sectional view of a first stator vane configuration which can be used in the invention.

Referring now to FIG. 3, there are shown cross-sectional views of two alternative stator vane configurations, either of which can be used in arrays in accordance with the present invention. Those features of the two vane configurations which are common to both are indicated by common reference numbers.

Referring firstly to FIG. 3, the stator vane 25 comprises an aerofoil cross section portion 29 which terminates at its radially inner and outer extents with a shroud portion 30 (only one of which can be seen in FIG. 3). The shroud portions 30 of adjacent stator vanes 25 abut and may where convenient be Joined. They cooperate to define radially inner and outer annular boundaries to the combustion product gas path which operationally flows over the stator aerofoil portions 29.

Externally, the aerofoil cross-section portion 29 is of conventional aerofoil-shape configuration. Thus it comprises a leading edge 31, a trailing edge 32, a convex suction flank 33 and a concave pressure flank 34. However, unlike conventional turbine stator aerofoil vanes, a major portion 35 of the convex suction flank 33 is movable with respect to the remainder 36 of the aerofoil portion 29. Thus almost the total radial extent of the flank portion 35 between the radially inner and outer shroud portions 30 is movable whereas the remainder 36 of the aerofoil portion 29 is firstly attached to the shroud portions 30 at its radially inner and outer extents.

The flank portion 35 is pivotally attached to the remainder 36 of the aerofoil portion 29 so that it pivots about a pivot line 37 (also visible in FIG. 2). The pivot line 37 is radially extending so as to be normal to the general direction of gas flow over the convex suction flank 33. It is also spaced apart, by a short distance in a span-wise sense, from the vane trailing edge 32 so that it is effectively adjacent the trailing edge 32. This distance is principally determined by the wall thickness required by the pivot and may be different in FIGS. 3 and 4.

The opposite upstream end 38 of the flank portion 35 to its pivot line 37 is spaced apart, by a short distance in a span-wise direction, from the vane leading edge 31. There is a limited degree of overlap between the upstream end 38 of the flank portion 35 and the portion 40 of the convex suction flank 33 which is defined by the remainder 36 of the aerofoil portion 29. Thus a sliding Joint 39 is defined by the overlapping portions with the flank portion upstream end 38 being partially overlaid by the flank portion 40. In order to ensure that the external surface of the suction flank 33 is maintained as smooth as possible for aerodynamic reasons, the edge of the overlying flank portion 40 is leathered so as to be of generally tapered cross-sectional form.

A narrow radially extending clearance groove 41 (shown enlarged) is provided in the suction surface 33 adjacent the pivot line 37. This is to permit a limited degree of pivoting of the flank portion 35 relative to the remainder 36 of the aerofoil portion 29. The groove 41 will inevitably provide a certain degree of disturbance to gases flowing over the vane 25. However it is located in such a position on the vane 25 that the aerodynamic penalties of such disturbances are acceptable.

Pivotal movement of the flank portion 35 relative to the remainder 36 of the aerofoil position is controlled by the rotation of a lobed cross-section actuation spindle 60. The spindle 60 is located within the aerofoil portion 29 adjacent the upstream end 38 of the flank portion 35. It extends along the radial length of the stator vane 25 and, as can be seen in FIG. 2, protrudes beyond the radially outer extent of the vane 25.

Figure 5:
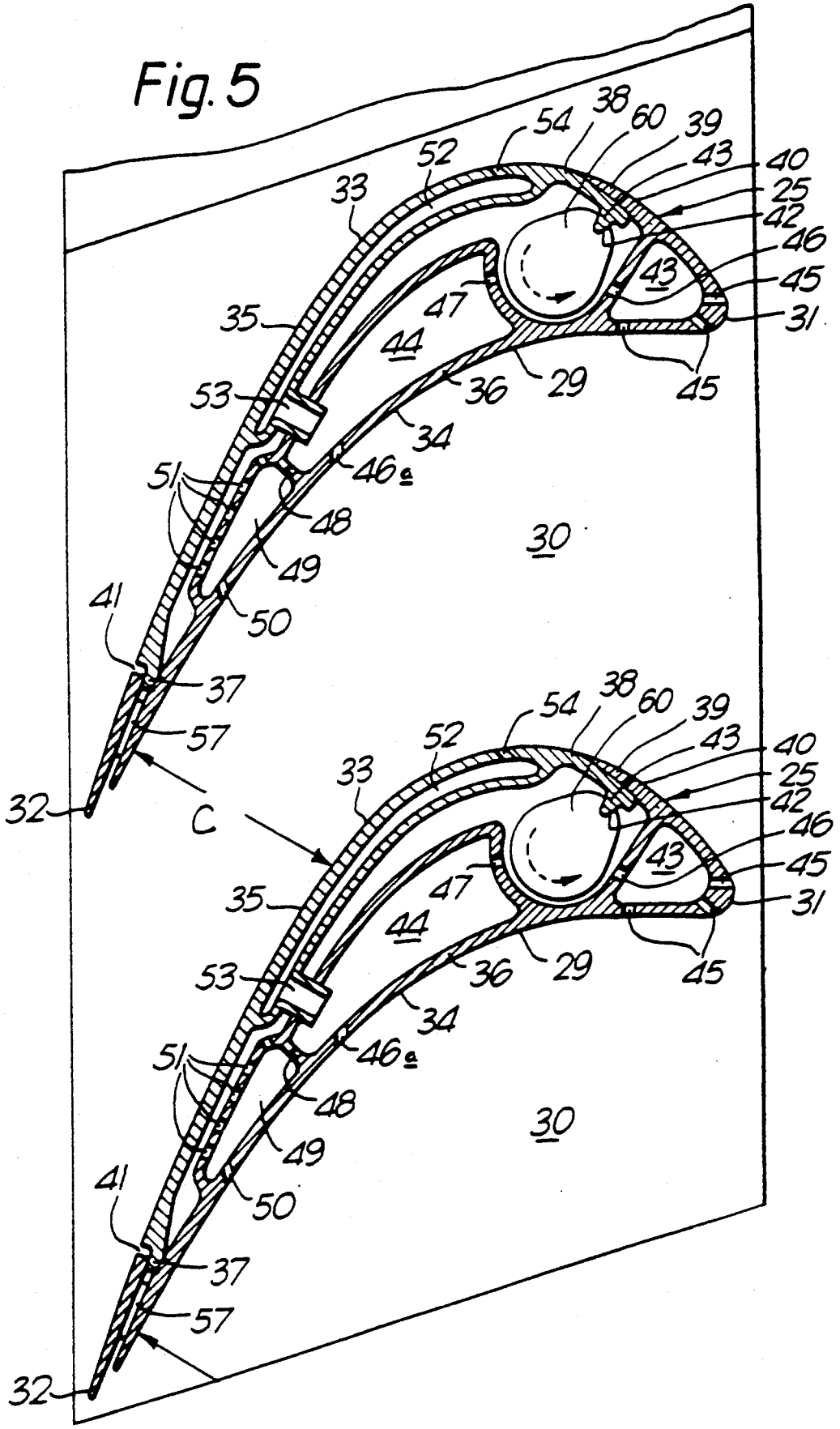
FIG. 5 is a cross-sectional view of two adjacent stator vanes which shows a gas flow path between the vanes.

Referring now to FIG. 5, the lobed portion of the spindle 60 is provided with a lengthwise extending groove 42 which receives a corresponding ridge 43 provided on the upstream end 38 of the flank portion 35. It will be understood however that if necessary two or more grooves and two or more ridges could be used in the manner of gear teeth. Rotation of the spindle in a clockwise or anti-clockwise direction thus results in the flank portion 35 being pivoted about the pivot line 37. This in turn brings about corresponding changes in the distance C between the flank portion 35 and the concave pressure flank 34 of the stator vane 25 which is circumferentially adjacent to it. It will be seen therefore that by changing the distance C, the gas flow area between adjacent stator vanes 25 and their associated radially inner and outer shroud positions 30 will change correspondingly. This gas flow area is referred to as the throat 61 between adjacent stator vanes 25. This variation in the distances C, and hence the cross-sectional areas of the throats 61, has a direct effect upon the total effective gas flow area of the annular array of stator vanes 25.

The portions of the spindles 60 which extend radially outwardly of the stator vanes 25 permit the actuation of the spindles 60 by a suitable drive mechanism (not shown). Such mechanisms are well known to those skilled in the art. Thus for example, each of the spindles 60 could be provided at its radially outer extent with a lever. The levers would all be attached to a single actuation ring extending around the circumference of the casing of the high pressure turbine 16. Limited rotation of the ring would result in corresponding limited rotation of the spindles 60.

Referring back to FIG. 3, the interior of the aerofoil portion 29 is divided by walls into a number of radially extending passages into which flows of cooling air are directed. Specifically, the vane 25 has two primary passages 43 and 44 into which cooling air is directed in the conventional way. The passage 43 is adjacent the vane leading edge 31. A number of holes 45 permit some of the cooling air to be exhausted from the passage 43 on to the external surface of the aerofoil portion 29 to provide film cooling thereof. Further holes 46 permit cooling air to flow into the compartment which contains the spindle 60, thereby providing cooling of the spindle 60.

The passage 44 is located in the central part of the aerofoil portion 29 and is interconnected with the external surface of the aerofoil portion 29 by a number of holes **46*a*. Like the holes 45, they provide film cooling of the external surface of the aerofoil portion 29. Further holes 47 permit additional cooling air to be directed into the compartment containing the spindle 60. In addition holes 48 permit cooling air to flow into a smaller compartment 49 which is located between the compartment 44 and the trailing edge 32. The compartment 49 has holes 50 which provide film cooling of the external surface of the aerofoil portion 29. Additionally, it has holes 51 which direct cooling air on to part of the internal surface of the flank portion 35, thereby providing impingement cooling of the flank portion 35. It may be necessary under certain circumstances to augment the air supply to passage 49 by holes through the shrouds 30**.

The flank portion 35 is, along the mid-portion of its span-wise extent, of double walled construction so that a passage 52 is defined between the walls. The passage 52 is supplied with cooling air through a series of short pipes 53 which interconnect the compartment 52 with the passage 44. Each of the pipes 53 is attached to the inner of the double walls of the flank portion 35. However it is a sliding fit in a correspondingly shaped aperture in the wall of the passage 44. This is to ensure communication between the passage 44 and the passage 52 for different pivotal positions of the flank portion 35. Cooling air flows from the passage 44 into the passage 52 through the pipes 53. The air thereby provides cooling of the flank portion 35. The air is exhausted from the passage 52, which may contain cooling features such as ribs or pedestals of conventional configuration through holes 54 to provide film cooling of the external surface of the flank portion 35. A principal purpose of the cooling system described above is to enable the cooling air pressure behind the movable flank portion 35 to be maintained at a low level to minimize the leakage flows Joining the working gas flow in the passage.

Finally, the trailing edge 32 region is provided with a series of span-wise extending passages 57 through which cooling air from the interior of the aerofoil portion 29 is exhausted through holes or slots in the pivot parts.

It will be seen therefore that notwithstanding the fact that the vane 25 is provided with a movable portion, it has an adequate degree of internal air cooling.

Figure 4:
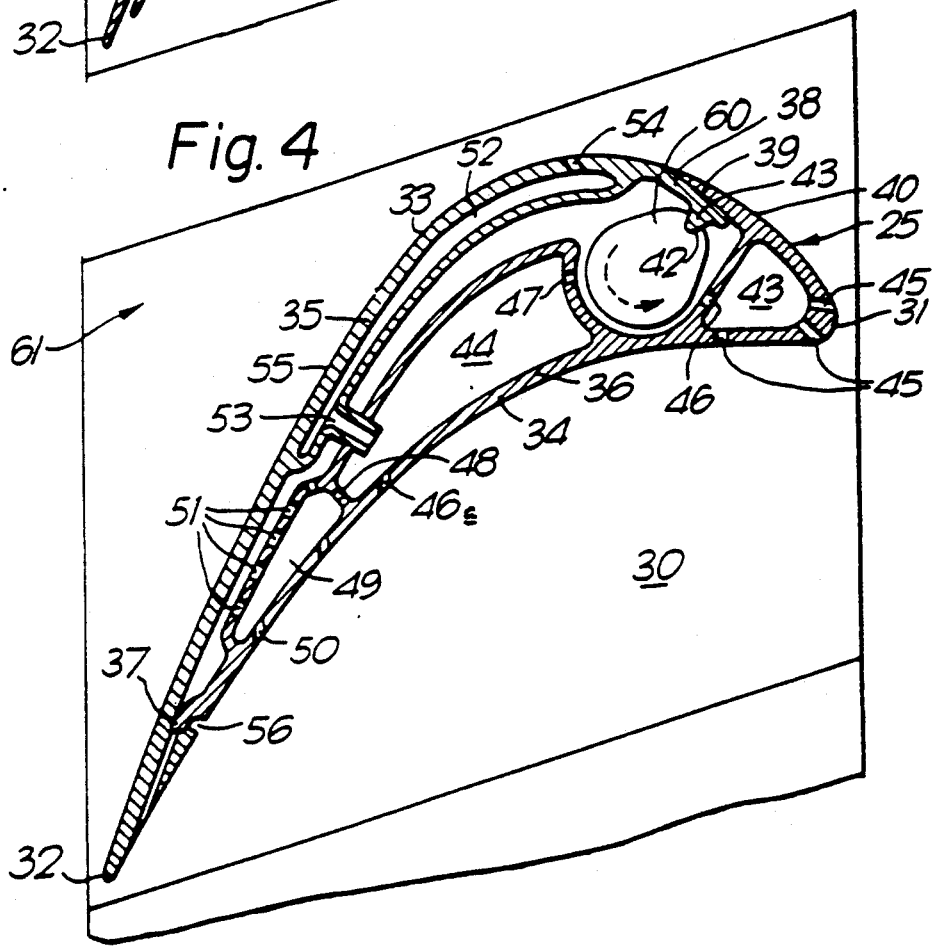
FIG. 4 is a cross-sectional view of a second stator vane assembly which can be used in the present invention.

Referring now to FIG. 4, in most respects it is similar to FIG. 3 and as stated earlier, common reference numbers are used in respect of common features. The major difference between resides in the manner in which the flank portion 35 is pivotally attached to the remainder 36 of the aerofoil portion 29.

Thus in FIG. 4, the flank portion 55 is elongated in a span-wise direction so that it additionally defines the trailing edge 32 and the downstream portion of the concave suction surface 34. As a consequence, although the pivot line 37 may be in the same portion as in FIG. 3, the radially extending clearance groove 56 is on the concave pressure flank 34, not the convex suction flank 33.

The benefit brought about by this arrangement is that when the flank portion 35 is pivoted about the pivot line 37, the portion of the aerofoil associated with the trailing edge 32 moves towards or away from the flank portion 35 of the adjacent vane, thereby causing greater variation in the value of C and thus the effective gas flow area of the annular array of nozzle guide vanes 25. Furthermore, the clearance groove 56 is now in a position where it will cause reduced disturbance to the operational gas flow.

Although the present invention has been described with reference to two types of flank portion 35, 55 which are of different sizes, it will be appreciated that flank portions of other sizes and configuration could be used if so desired. Indeed it may be desirable under certain circumstances to provide each vane 25 with two pivotable flank portions: one on the pressure flank and the other on the suction flank.

It will be seen therefore that stator vanes in accordance with the present invention offer improved gas leakage resistance between the aerofoil portions and shroud portions than has been the case with the previous variable stator vanes. Thus although the flank portions 35, 55 are movable so that cooling, air or gaseous combustion products can leak between them and the shroud portions. The pressure difference causing such leakage can be greatly reduced and the clearance gaps can be closely controlled since only two individual parts are involved for each stator. Although the present invention has been described with reference to a ducted fan gas turbine engine, it will be appreciated that it could also be applied to gas turbine engines of other types.

I claim:

1. A gas turbine engine stator vane assembly comprising an annular array of substantially radially extending stator vanes circumferentially spaced apart so that throats are defined between circumferentially adjacent stator vanes, each of said stator vanes comprising an aerofoil cross-sectional portion having a leading edge, a trailing edge, a pressure flank and a suction flank, each of said flanks interconnecting said leading and trailing edges, wherein at least a portion of the suction flank of each of said vanes is pivotally attached to the pressure flank of that vane to pivot about a line which is normal to the general direction of gas flow to provide variations in the cross-sectional areas of said throats between adjacent stator vanes, mechanical actuation means for pivoting said portions of said suction flank about respective pivot lines to facilitate said variations in throat cross-sectional area, wherein said pivot line is located adjacent to said trailing edge of its respective stator vane.

2. The gas turbine engine stator vane assembly as claimed in claim 1, wherein said actuation means comprises a rotatable spindle disposed within each said stator vane, each of said flank portions being responsive to rotational movement of said spindle.

3. The gas turbine stator vane assembly as claimed in claim 1, wherein said pressure flank portions enclose one or more cooling air passages, said pressure flank portion having holes formed therein for exhausting cooling air from said one or more cooling air passages to the exterior surface of said stator vane.

4. The gas turbine engine stator vane assembly as claimed in claim 3, wherein said holes are positioned to provide for film cooling of at least part of the exterior surface of said stator vane.

5. The gas turbine engine stator vane assembly as claimed in claim 1, wherein said suction flank portions enclose one or more cooling air passages into which a flow of cooling air is operationally directed, said suction flank portion having holes formed therein for exhausting cooling air from said one or more passages to the exterior surface of said stator vane.

6. The gas turbine engine stator vane assembly as claimed in claim 5, wherein said holes (54) are so positioned and arranged as to provide film cooling of at least part of the exterior surface of said suction flank portion (35).

7. The gas turbine engine stator vane assembly as claimed in claim 5, wherein said cooling air is directed from said pressure flank portion cooling air passages to said suction flank portion cooling air passages.

* * * * *